United States Patent [19]

Zhestkov et al.

[11] 4,269,599

[45] May 26, 1981

[54] COOLING SYSTEM OF SELF-PROPELLED FLOATING CRANE ENGINES

[76] Inventors: Vladimir M. Zhestkov, prospekt Generala Ostryakova, 106, kv. 49; Vladimir M. Tsypin, ulitsa Volodarskogo, 5, kv. 5; Mikhail Z. Grzhebin, ulitsa Drozdova, 3, kv. 35; Vadim A. Kaminsky, ulitsa Istomina, 14-b, kv. 48; Vitaly G. Mazepov, ulitsa Jumasheva, 8, kv. 18, all of Sevastopol, U.S.S.R.

[21] Appl. No.: 70,038

[22] Filed: Aug. 27, 1979

[30] Foreign Application Priority Data

Aug. 30, 1978 [SU] U.S.S.R. ..... 2662126

[51] Int. Cl.[3] ..... B63H 23/32; B63B 39/03

[52] U.S. Cl. ..... 440/88; 114/125; 114/269; 212/191; 165/41

[58] Field of Search ..... 114/125, 268, 269; 440/88; 212/191; 165/41, 44

[56] References Cited

U.S. PATENT DOCUMENTS

| | | | |
|---|---|---|---|
| 368,402 | 8/1887 | Kirkland et al. | 440/88 X |
| 1,000,152 | 8/1911 | Correll | 212/191 |
| 2,024,822 | 12/1935 | Hort | 114/125 |
| 3,716,154 | 2/1973 | Berg et al. | 114/125 |

FOREIGN PATENT DOCUMENTS

| | | | |
|---|---|---|---|
| 384313 | 11/1923 | Fed. Rep. of Germany | 440/88 |
| 567960 | 3/1924 | France | 165/44 |

*Primary Examiner*—Albert W. Davis

*Attorney, Agent, or Firm*—Steinberg & Raskin

[57] ABSTRACT

A cooling system of self-propelled floating crane engines, in which an external hydraulic circuit intended to cool internal hydraulic circuits of engines comprises pipelines, pumps, tanks filled with liquid, and skin heat exchangers. The tanks are compulsorily connected to each other and arranged so that a portion of their surface is integrated into an underwater outer skin of a floating crane pontoon, whereas the skin heat exchangers disposed in said tanks are essentially a surface heat exchangers being connected to the internal hydraulic circuit of at least one of the engines, and the pipelines of the external hydraulic circuit are connected to the tanks and to the internal hydraulic circuits of the rest of the engines.

2 Claims, 1 Drawing Figure

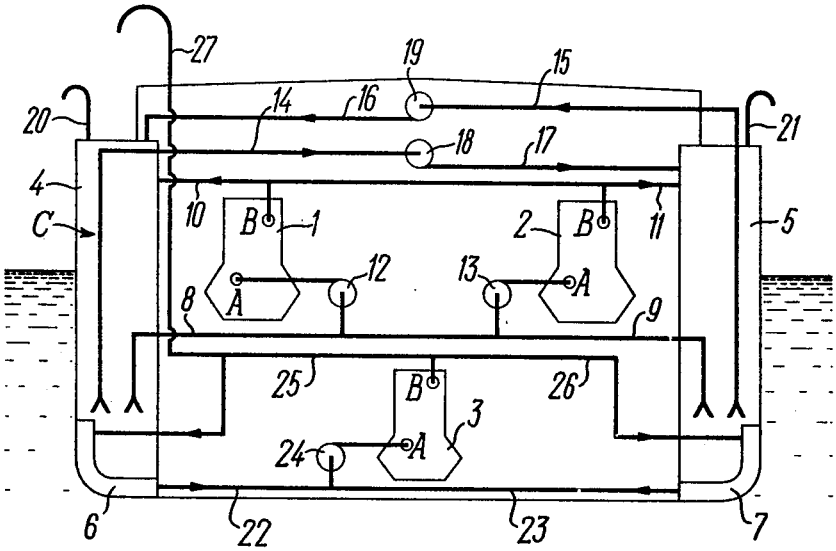
27
19
15
20
14
16
21
18
17
4
10
11
C
B
1
2
B
5
12
13
A
A
8
9
25
26
B
3
24
A
6
22
23
7

COOLING SYSTEM OF SELF-PROPELLED FLOATING CRANE ENGINES

The present invention relates to the shipbuilding and, more particularly, to cooling systems of engines of self-propelled floating cranes.

There are known cooling systems of ship engines which employ circulation of liquid in a closed circuit through a skin heat exchanger.

Though the term "skin heat exchanger" is known to those skilled in the art, to avoid misunderstanding we explain that this term stands for a heat exchanging apparatus one of the surfaces of which is made integral with an underwater skin of a ship.

There are also known cooling systems of ship engines wherein heat is removed from an internal hydraulic circuit of each engine through an external hydraulic circuit which incorporates a skin heat exchanger employing a forced circulation of liquid.

Such cooling systems are comparatively simple and employed, as a rule, on the ships working in contaminated water areas, e.g., on floating cranes, tugboats, mud dredgers and the like.

As the above ships work for a long time in the same location, the heat transfer between liquid being cooled and outside water is relatively small. To obtain the necessary thermal conditions of operation of engines, a heat exchanger area should be great enough, especially on the ships having comparatively powerful engines.

There are further known engine cooling systems without suction of outside water wherein an external hydraulic circuit is connected to side or bottom tanks being used in the main as heat accumulators.

Such systems are generally used on icebreakers.

Said systems are also simple and quite efficient, especially when used on the ships sailing in cold seasons and in cold-water basins.

To use such systems on the ships sailing in different seasons and in different basins, it becomes necessary to have tanks of substantially great volume in order to provide normal thermal conditions for the engine operation.

Known in the art is also a ship engine cooling system wherein internal hydraulic circuits of the engines are connected to an external hydraulic circuit. The external hydraulic circuit comprises pipelines passing through heat exchangers of the internal hydraulic circuits and connected to tanks filled with outside water and communicating in their turn with a skin heat exchanger. The heat exchanger is positioned at some distance from the tanks and associated therewith through pipelines provided with built-in pumps.

This cooling system employs accumulating capacity of water contained in the tanks and additionally cooled in the skin heat exchanger.

Such a cooling system may be used to the best advantage on floating cranes since the operation of the engines during cargo-handling operations is charcterized by a short-time increase of load on the engine in the process of cargo lifting and by continuous but comparatively low loads in the course of preparatory operations, viz., while preparing cargo for lifting or when slinging it.

In such systems one and the same heat carrier, mainly outside water, is pumped both through the tanks and the skin heat exchanger. The use of outside water is caused by that usually employed as tanks of the cooling system are ballast, heeling or trimming tanks which under varying operating conditions are either drained or filled and therefore the use of liquid such as fresh water with anticorrosive additive is economically inexpedient and practically almost impossible.

Moreover, outside water circulating in the skin heat exchanger causes intensive corrosion and fouling. As a result, the heat exchanger must be of very simple construction, which in turn results in a decreased efficiency of apparatus.

Besides, in the cooling system described above the internal hydraulic circuits of all the engines are connected to a common external hydraulic circuit but on the self-propelled floating crane during cargo-handling operations (lifting, transfer and lowering of cargo) only a part of engines operates.

The most of its time the floating crane is engaged in cargo-handling operations.

Therefore the engines used for propelling the floating crane operate for a shorter time than those used for ensuring the cargo-handling operations.

That is why the cooling system employing a common cooling circuit for all engines must have all components featuring high reliability, and consequently such a system would be of substantially high weight, overall dimensions and cost.

It is an object of the present invention to provide such a cooling system of engines of a floating crane in which an external hydraulic circuit being relatively simple in design and compact would enable an autonomoys cooling of internal hydraulic circuits of the engines ensuring cargo-handling operations of the crane.

It is another object of the present invention to increase the operational reliability of the engines intended for operating the crane.

A further object of the present invention is to decrease the overall dimensions and weight of a cooling system.

A still further object is to reduce the production cost of a cooling system.

It is one more object of the present invention to extend the service life of the engines which provide for cargo-handling operations of the crane.

With these and other objects in view, there is proposed a cooling system of self-propelled floating crane engines wherein an external hydraulic circuit intended to cool internal hydraulic circuits of engines, comprises pipelines, pumps, tanks filled with liquid, and skin heat exchangers and in which according to the invention the tanks are compulsorily connected to each other and arranged so that a portion of their surface is formed by an underwater outer skin of a floating crane pontoon, the skin heat exchangers are disposed in said tanks, made in the form of surface heat exchangers and connected to the internal hydraulic circuit of at least one of the engines, and the pipelines of the external hydraulic circuit are connected to the tanks and to the internal hydraulic circuits of the rest of the engines.

It is expedient that the tanks arranged on the opposite sides of the floating crane and intended to right the heel be used as the tanks of the external hydraulic circuit.

The use of these tanks compulsorily connected to each other usually by heeling pumps makes it possible to simplify the cooling system since heeling of a crane occurs when the heaviest cargoes are lifted. At that time the engine serving the crane mechanisms is loaded to the utmost and liberates much heat. Therefore, the transfer of liquid from one tank to the other produces, without consuming additional energy, a certain flow of water over the skin heat exchanger, thereby intensifying the heat transfer from the heat exchanger into water contained in the tanks.

The cooling system of self-propelled floating crane engines according to the present invention provides for reliable operation of the engines though it is relatively inexpensive and has the optimum weight and overall dimensions.

The invention will now be described with reference to a specific embodiment thereof, taken in conjunction with the accompanying drawing wherein a cooling system of self-propelled floating crane engines is shown schematically in accordance with the invention.

Mounted on a self-propelled floating crane are engines 1, 2 intended to propel the floating crane and an engine 3 ensuring the cargo-handling operations of the crane. The power of the engine 3 is selected to be proportional to the capacity of crane mechanisms (not shown), and, as a rule, the power developed by the engine 3 is considerably lower than that of the engines 1, 2. At the opposite sides of the floating crane located are tanks 4,5 the main function of which is to right the heel occurring in the process of the cargo-handling operations.

The cooling system has internal hydraulic circuits of the engines 1, 2 and 3. Said circuits are not the subject matter of the present invention and therefore they are not discussed herein and may have any construction suitable for the purpose. There are shown in the drawing only inlets A and outlets B of the internal hydraulic circuits connected to the external hydraulic circuit C.

For cooling the internal hydraulic circuits use is made of the external cooling circuit C which comprises liquid-filled tanks, particularly in the described embodiment of the invention tanks 4 and 5 are used, and skin heat exchangers 6,7.

The tanks 4, 5 are disposed so that a portion of their surface forms an outside sking of a floating crane pontoon. Surface heat exchangers 6,7 are installed in said tanks, to thus reduce the overall dimensions of the external hydraulic circuit C.

The surface area of the skin heat exchangers 6,7 made up by the underwater outer skin of the floating crane pontoon is selected to be such as to provide normal operation of the engine 3 loaded up to 40–50% of its rated power. In this case the tanks 4,5 may be filled with water only partially or even emplied.

The external hydraulic circuit also comprises suction pipelines 8,9 and delivery pipelines 10 and 11. The pipelines 8 and 9 incorporate built-in pumps 12 and 13, respectively.

One ends of the pipelines 8 and 9 are connected to the inlets A of the internal hydraulic circuits of the engines 1 and 2, whereas other ends are disposed in the lower part of the tanks 4, 5 close to the skin heat exchangers 6,7.

One ends of the pipelines 10 and 11 are connected to the outlets B of the internal hydraulic circuits of the engines 1,2 and their other ends are connected to the tanks 4,5.

The tanks 4 and 5 are compulsorily communicated with each other through suction pipelines 14 and 15 and delivery pipelines 16 and 17. Pumps 18, 19 are arranged between the suction pipelines 14, 15 and the delivery pipelines 16, 17.

The tanks 4 and 5 communicate with the atmosphere through pipes 20 and 21 to protect them from being overflooded and against excess pressure.

For cooling the internal hydraulic circuit of the engine 3 which actuates the crane mechanisms (not shown) its inlet A is connected through suction pipelines 22 and 23 and a pump 24 built therein to the skin heat exchangers 6 and 7, respectively, and its outlet B through delivery pipelines 25 and 26 is connected to the skin heat exchangers 6 and 7, respectively. Thus, the internal hydraulic circuit of the engine 3 is cooled over a self-contained closed hydraulic circuit which employs fresh distilled water with anitcorrosive and antifreeze additive as cooling liquid. The use of relatively expensive cooling liquid is accounted for by that its amount circulating in the cooling circuit of the engine 3 is relatively small, the cooling liquid is utilized for a long time and the operational reliability of the engine 3 is increased.

To prevent rise of excess pressure in the skin hear exchangers 6, 7, a pipe 27 is connected to the delivery pipelines 25 and 26 for communicating them with the atmosphere. The liquid will be ejected through said pipe in case of clogging of the skin heat exchangers 6, 7. The use of pipe 27 makes it possible to choose the thickness of walls of the heat exchangers 6, 7 depending only on the internal pressure in the heat exchangers 6, 7. and not to take into account the maximum pressure built up by the pump 24.

With such an external hydraulic circuit employed for cooling the internal hydraulic circuit of the engine 3, the internal hydraulic circuits of the engines 1, 2 may be cooled by means of an open hydraulic circuit, i.e., with sucking outside water and discharging it overboard.

The cooling system of self-propelled floating crane engines operates as follows.

With the closed external circuit C used for cooling the operating engines 1,2 heat is removed by water circulated through the suction pipelines 8, 9, the delivery pipelines 10, 11 and the tanks 4, 5 by the pumps 12, 13. Other ways of connecting the engines 1, 2 to the tanks 4, 5 are also possible.

Such an operating mode is used to propel the floating crane in a contaminated water area and its duration is limited by the accumulating capacity of the tanks 4, 5. As a rule, the engines 1, 2 have certain limitations as to the maximum inlet temperature of cooling water, and therefore as soon as the water temperature reaches its peak values in the tanks 4, 5, it is necessary to cease cooling the engines by means of the closed circuit and to change over to cooling by means of an open circuit or to leave in advance the contaminated water area for a clean one in order to replace water in the tanks 4, 5 therein. When moving in the clean water area it is advantageous to cool the engines 1, 2 employing an open cycle.

The cargo-handling operations are usually performed with the floating crane staying in one place. At this time the engine 3 operates and heat is removed from the internal hydraulic circuit thereof by liquid circulated with the pump 24 through the suction lines 22, 23 and the delivery pipelines 25, 26 and passed through the skin heat exchangers 6, 7. The liquid in its turn transfers heat through the external surface of the skin heat exchangers 6, 7 to the surrounding medium, i.e. to outside water and to water contained in the tanks 4, 5.

As the skin heat exchanger 6(7) the surface area of which is selected to be such as to ensure cooling of the engine 3 loaded to about 40–50% of its rated power with dissipation of heat only to outside water through an external surface thereof, is washed with water from both sides, then the heat removal is guaranteed with the engine 3 operating at full load. With an increase in temperature of water contained in the tanks 4, 5 followed by worsening of the heat transfer from liquid contained in the skin heat exchangers 6, 7 into water contained in the tanks 4, 5, the pumps 18, 19 are started. This done, water in the tanks 4, 5 is caused to flow at a certain speed with respect to the skin heat exchangers 6, 7, thereby improving the heat transfer therefrom.

Practically, the engine 3, is fully loaded only when heavy cargoes are handled. At this time the heeling system of the floating crane operates and consequently the pumps 18, 19 operate too, creating flow of water in the tanks 4, 5.

In some cases, e.g., when it is necessary to have the minimum aught (the tanks 4,5 should be emplied), the engine 3 must operate at a partial load to preclude overheating thereof.

The engine 3 may be sometimes used to propel the floating crane, in which case the heat transferring abilities of the skin heat exchangers 6, 7 are increased due to outside water flowing at a certain speed about their surface, and the engine 3 may operator at a greater load.

Since the construction of the skin surface heat exchangers 6, 7 does not form the subject matter of the present invention it is not described herein and may be any suitable for the purpose.

In case the skin heat exchangers 6, 7 are clogged, liquid will be ejected through the pipe 27 overboard.

The dimensions of the heat exchangers 6, 7 depend in the main, with a certain type chosen for use, upon the power of the engine 3. Therefore to have the cooling system of the optimum dimensions, weight and cost, the power of the engine 3 is chosen basing only on the capacity of the crane mechanisms without taking into account the power of the engines 1, 2 used for propelling the floating crane.

Selection of the engine 3 having the power required for carrying out the cargo-handling operations of the crane will bring about its optimum loading, increasing its efficiency and reducing the heat transfer into the cooling liquid as compared with the heat transfer from an engine not specially designed for actuating the crane mechanisms and consequently operating at off-design rating.

What is claimed is:

1. A cooling system of self-propelled floating crane engines, comprising:
   - internal hydraulic circuits of said engines;
   - external hydraulic circuit cooling said internal hydraulic circuits, incorporating:
   - tanks filled with liquid and compulsorily connected to each other;
   - said tanks arranged on the pontoon of said floating crane so that an underwater outer skin of the pontoon of said floating crane forms a portion of their surface;
   - skin heat exchangers made in the form of surface heat exchanging apparatus and disposed in said tanks;
   - pipelines provided with built-in pumps and connecting said heat exchangers with at least one of said internal hydraulic circuits;
   - said skin heat exchangers, pipelines with a built-in pump forming a self-contained hydraulic circuit for cooling at least one internal hydraulic circuit;
   - other pipelines with the built-in pumps connecting said tanks with said internal hydraulic circuits of the rest of said engines.

2. A cooling system as claimed in claim 1, wherein used as said system tanks are the tanks disposed on the opposite sides of the floating crane and intended to right the heel.

* * * * *